US007326844B2

(12) United States Patent
Nishida

(10) Patent No.: US 7,326,844 B2
(45) Date of Patent: Feb. 5, 2008

(54) KEYBOARD APPARATUS

(75) Inventor: Kenichi Nishida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/489,303

(22) Filed: Jul. 18, 2006

(65) Prior Publication Data

US 2007/0018960 A1 Jan. 25, 2007

(30) Foreign Application Priority Data

Jul. 20, 2005 (JP) ..... 2005-210605

(51) Int. Cl.
*G10D 13/02* (2006.01)

(52) U.S. Cl. ..... 84/423 R

(58) Field of Classification Search ..... 84/423 R, 84/477, 478, 430, 441, 423 A
See application file for complete search history.

(56) References Cited

U.S. PATENT DOCUMENTS 4,914,999 A 4/1990 Masubuchi et al.
6,087,575 A * 7/2000 Niitsuma ..... 84/423 R
6,133,517 A 10/2000 Masubuchi

FOREIGN PATENT DOCUMENTS

| | | |
|---|---|---|
| DE | 42 36 998 A1 | 5/1994 |
| GB | 2239548 A | 7/1991 |
| JP | 06-214569 | 8/1994 |
| JP | 2003-084768 | 3/2003 |
| JP | 2004-234019 | 8/2004 |

* cited by examiner

*Primary Examiner*—Kimberly Lockett
(74) *Attorney, Agent, or Firm*—Morrison & Foerster LLP

(57) ABSTRACT

Frame on which a plurality of keys are operably mounted has a continuous surface defining a channel-shaped concave section extending in a direction where the keys are arranged, and a body section in which the frame is mounted has a supporting surface that contacts opposite sides of an opening of the channel-shaped concave section of the frame. The opposite sides of the opening of the channel-shaped concave section of the frame are fixed to the supporting surface of the body section. Thus, a closed-section structure is formed by the channel-shaped concave section of the frame and the supporting surface of the body section, which constitutes a semi monocoque structure extending in the key-arranged direction. Such a structure can enhance bending rigidity and twisting rigidity relative to the key-arranged direction.

3 Claims, 5 Drawing Sheets

KEYBOARD APPARATUS

BACKGROUND OF THE INVENTION

The present invention relates generally to music-performing keyboard apparatus applicable to electronic musical instruments etc. and more particularly to an improved keyboard apparatus having an increased overall rigidity.

Music-performing keyboard apparatus, applied to electronic musical instruments etc., basically comprise a plurality of performing keys arranged side by side in a horizontal direction, Thus, the keyboard apparatus are generally elongated in shape in a direction of scale notes (i.e., key-arranged direction), so that a force produced by depression of a key during a performance acts in a direction to bend a horizontally-elongated apparatus casing as illustrated in FIG. 7. Further, when the keyboard apparatus are lifted for transfer of the keyboard apparatus, a force acts in a direction to twist the horizontally-elongated apparatus casing. For these reasons, it is desirable that the keyboard apparatus be designed to enhance the rigidity against bending (i.e., bending rigidity) and rigidity against twist (i.e., twisting rigidity) relative to the note scale (i.e., key-arrange) direction.

Typically, primary components forming a rigid structure of the keyboard apparatus are a keyboard frame and body section (casing). A plurality of keys are mounted on the keyboard frame in such a manner that they are operable (i.e., they can be caused to pivot) by a human player, and the keyboard frame is normally formed of synthetic resin, such as plastic, in order to reduce the weight of the keyboard apparatus for enhanced portability of the keyboard apparatus, reduce the manufacturing cost of the keyboard frame and meet other requirements. The body section (casing) mounts therein the keyboard frame with the keyboard mounted thereon, and this body section (casing) is also formed of synthetic resin, such as plastic, for reduced weight. The shapes and mounting structures of the frame and body section (casing) determine the rigidity of the entire keyboard apparatus.

FIG. 8 is a sectional view showing examples of shapes and mounting structures of the frame and casing in a conventional keyboard apparatus. In FIG. 8, the frame, on which are mounted a plurality of keys 1, has a concave sectional shape of a substantial inverted U opening downwardly. The frame 2 and casing 3 are fix to each other via screws 4 or the like other only along one side 2*a* of the opening of the frame 2, and the other side 2*b* of the opening of the frame 2 is supported only by abutting against the casing 3; the other side 2*b* is not positively fixed to the casing 3. Namely, a space defined by the downwardly-opening concave sectional shape and the casing 3 does not have a closed sectional shape, and thus, both the frame 2 and casing 3 may easily flex so that sufficient bending rigidity and twisting rigidity relative to the note scale direction is not achievable.

FIG. 9 is a sectional view showing other examples of shapes and mounting structures of the frame and casing in a conventional keyboard apparatus. The mounting structure of the frame 2 relative to the casing 3 in FIG. 9 is similar to that shown in FIG. 8, and the casing 3 has a predetermined end section 3*a* bent into a concavo-convex (or staggeringly-bent) structure. End surfaces of the concavo-convex structure are not positively fixed, so that the end surfaces of the concavo-convex structure tend to be detached from the frame 2. Thus, in this case too, sufficient bending rigidity and twisting rigidity relative to the scale direction is not achievable.

FIG. 10 is a sectional view showing still other examples of shapes and mounting structures of the frame and casing in a conventional keyboard apparatus. The frame 2 of a downwardly-opening concave sectional shape has a predetermined intermediate section 2*c* bent into a concavo-convex structure having a plurality of concave and convex portions. The frame 2 and casing 3 are fixed to each other not only along one side 2*a* of the opening of the frame 2 via screws 4 or the like, but also along the other side 2*b* of the opening of the frame 2 via screws 5 or the like. In this case, the space defined by the frame 2 and casing 3 has a closed sectional shape, but, because the closed space has a considerably great sectional area, the frame 2 and casing 3 can easily flex so that sufficient rigidity is hardly achievable. Further, although the concavo-convex structure, extending in the note scale (key-arrange) direction, can function to enhance the bending rigidity relative to the note scale (key-arrange) direction, sufficient twisting rigidity is hardly achievable because the end surfaces of the concavo-convex structure are not positively fixed. It is conceivable to reinforce the underside or the like with an external member 6 to thereby secure sufficient rigidity of the entire keyboard apparatus as illustrated in FIG. 10; however, such an approach can not said to be advisable because the provision of the reinforcing member would result in various inconveniences, such as an increased cost and increased weight.

SUMMARY OF THE INVENTION

In view of the foregoing, it is an object of the present invention to provide an improved keyboard apparatus which has an increased rigidity through a combination of a frame and body section (casing) even with a simple construction that does not increase the weight of the keyboard apparatus.

In order to accomplish the above-mentioned object, the present invention provides an improved keyboard apparatus, which comprises: a plurality of keys; a frame on which the plurality of keys are operably mounted; the frame having a continuous surface defining a channel-shaped concave section extending in a direction where the plurality of keys are arranged on and along the frame; a body section in which the frame is mounted, the body section having a supporting surface that contacts opposite sides of an opening of the channel-shaped concave section of the frame when the frame is mounted in place therein; and a fixation section where the opposite sides of the opening of the channel-shaped concave section of the frame are fixed to the supporting surface of the body section.

According to the present invention, the frame, on which the plurality of keys are operably mounted, has the continuous surface defining the channel-shaped concave section extending in the key-arranged (or note scale) direction, and the body section, in which the frame is mounted, has the supporting surface that contacts the opposite sides of the opening of the channel-shaped concave section of the frame. The opposite sides of the opening of the channel-shaped concave section of the frame are fixed to the supporting surface of the body section. Thus, a closed-section structure is formed or defined by the channel-shaped concave section of the frame and the supporting surface of the body section, which constitutes a "semi-monocoque" structure extending in the key-arranged direction. Such a structure can enhance bending rigidity and twisting rigidity relative to the note scale direction (key-arranged direction).

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
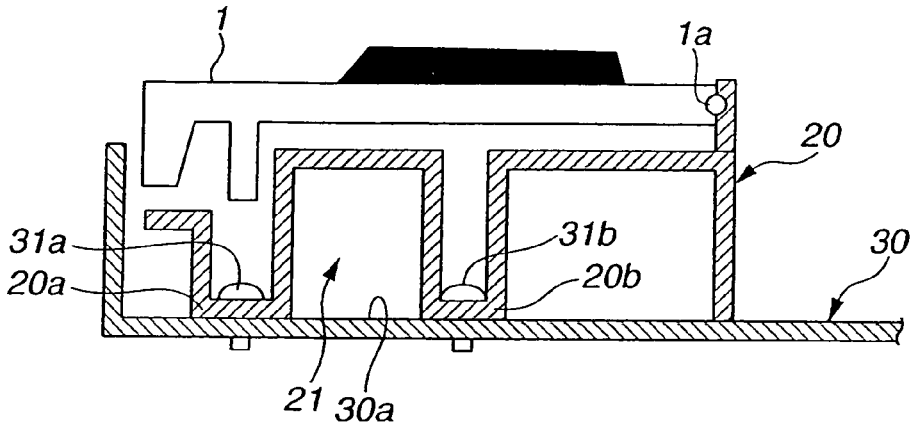
FIG. 1 is a sectional side view schematically showing a frame structure of a keyboard apparatus in accordance with a first embodiment of the present invention.

FIG. 1 is a sectional side view schematically showing relevant portions of a frame structure of a keyboard apparatus in accordance with a first embodiment of the present invention, which is employed in an electronic musical instrument. A plurality of keys 1 for performance operation are pivotably mounted via supporting points (or pivot shaft) on predetermined positions of a frame 20 formed of synthetic resin, in the same manner as conventionally known in the art. The frame 20 has a continuous surface defining a channel-shaped concave section 21, which extends in a direction where the keys 1 are arranged on and along the frame 20. Body section (casing) 30 for mounting therein the frame 20 has a supporting surface 30*a* that contacts wall regions of the frame 20 at opposite sides of an opening portion of the concave section 21 (hereinafter referred to as "opposite sides 20*a* and 20*b*" of the opening portion) when the frame 20 is duly mounted in place in the body section 30. In other words, the channel-shaped concave section 21 is formed into a relatively great depth in such a manner that the sides 20*a* and 20*b* of the downwardly-opening portion abut against the supporting surface 30*a*. The sides 20*a* and 20*b* of the downwardly-opening portion of the channel-shaped concave section 21 are fixed to the supporting surface 30*a* of the body section 30 by suitable fixation means (in the illustrated example, screws 31*a* and 31*b*). The number of positions at which the sides 20*a* and 20*b* are fixed via the screws 31*a* and 31*b* may be chosen as desired. Note that the above-mentioned "continuous surface" of the frame 20 is not limited to a complete flat surface; it may be a surface having one or more openings and/or uneven surface portions as necessary, as long as it has some kind of continuity.

With the sides 20*a* and 20*b* of the downwardly-opening portion of the frame's channel-shaped concave section 21 positively fixed to the supporting surface 30*a* of the body section (casing) 30 in the aforementioned manner, the combination of the frame's channel-shaped concave section 21 and the supporting surface 30*a* of the body section 30 can provide a closed-section structure that is closed in one direction with the supporting surface 30*a* of the body section 30 and closed in the remaining directions with the wall surfaces of the channel-shaped concave section 21 of the frame 20. Thus, the structure provided by the combination of the frame's channel-shaped concave section 21 and the supporting surface 30*a* of the body section 30 constitutes a tubular body of a semi-monocoque (i.e., semi-unitized) structure extending in the note scale (or key-arranged) direction, which is structurally and mechanically strong. As a consequence, the instant embodiment of the present invention can significantly enhance the bending rigidity and twisting rigidity relative to the note scale (key-arranged) direction with a simple, light-weight and low-cost construction, without the weight of the keyboard apparatus being increased by provision of a reinforcing member or the like.

Whereas the channel-shaped concave section 21 of the frame 20 is shown in the figure as being defined by the continuous surface bent in a rectangular shape, it may be formed by a curved continuous surface. Further, the means for fixing the sides 20*a* and 20*b* of the downwardly-opening portion of the frame's channel-shaped concave section 21 to the supporting surface 30*a* of the body section (casing) 30 are not limited to the semi-fixing type as set forth above, such as by the screws 31*a* and 31*b*, and it may be an adhesive or the like or may be a removable fixing type, such as a slide-fit or snap-fit engagement structure between the relevant components.

While the body section 30 mounting therein the frame 20 is typically in the form of a bottom plate section of an external casing of the keyboard instrument, the keyboard instrument may be mounted on a shelf board provided in the casing, depending on the type of the keyboard instrument. In the case where the basic principles of the invention are applied to such a type of keyboard instrument, the shelf board provided in the casing constitutes the body section 30 for mounting therein the frame 20. The supporting surface 30 of the body section 30 in the instant embodiment is not necessarily to be a flat surface as in the illustrated example and may be an uneven surface as necessary.

Figure 2:
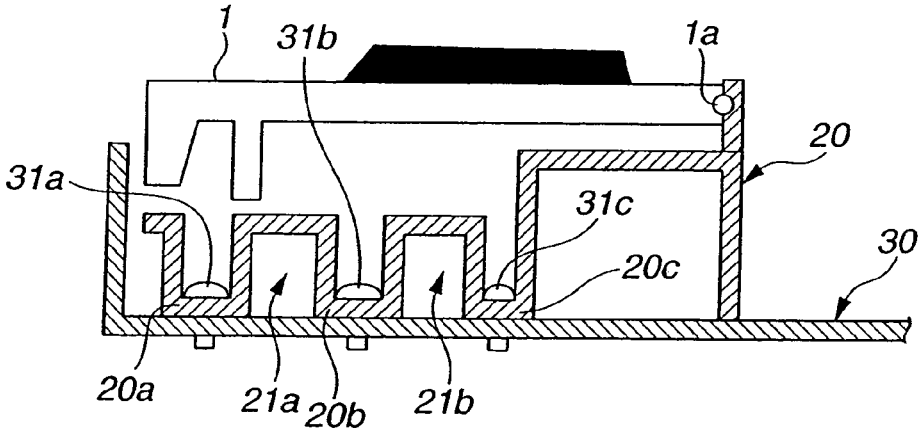
FIG. 2 is a sectional side view schematically showing a frame structure in a keyboard apparatus in accordance with a second embodiment of the present invention.

FIG. 2 is a sectional side view schematically showing a frame structure in a keyboard apparatus in accordance with a second embodiment of the present invention. In the second embodiment, the frame 20 has a continuous surface defining two parallel concave sections 21*a* and 21*b*. Further, the supporting surface 30*a* of the body section 30, mounting therein the frame 20, abuts against the sides 20*a*, 20*b* and 20*c* of the respective downwardly-opening portions of the concave sections 21*a* and 21*b* when the frame 20 is mounted in place in the body section 30 and thereby supports the concave sections 21*a* and 21*b* in abutting relation thereto. In this case, the respective sides 20*a*, 20*b* and 20*c* of the downwardly-opening portion of the channel-shaped concave sections 21*a* and 21*b* are positively fixed to the supporting surface 30*a* of the body section 30 by means of, for example, screws 31*a*, 31*b* and 31*c*. In this way, the two channel-shaped concave sections 21*a* and 21*b* form closed-section structures each achieving an enhanced bending rigidity and twisting rigidity relative to the note scale direction (key-arranged direction), so that they can enhance the rigidity of the entire keyboard apparatus in an additively or synergistic manner. As a modification, the opposite sides 20*a* and 20*b* of only one of the channel-shaped concave sections 21*a* may be positively fixed, by means of the screws 31*a* and 31*b* or the like, to the supporting surface 30*a* of the body section 30. In such a case, the bending rigidity and twisting rigidity relative to the note scale direction (key-arranged direction), enhanced by the channel-shaped concave section 21*a* forming the closed-section structure, can be additionally enhanced by the other channel-shaped concave section 21*b*.

Namely, in FIG. 2, there are shown two tubular bodies of the semi-monocoque structure formed parallel to each other by the two channel-shaped concave sections 21*a* and 21*b*. These two tubular bodies of the semi-monocoque structure achieve the benefit that they can even further enhance the rigidity of the entire keyboard apparatus with a reduced weight as compared to the single tubular body of the semi-monocoque structure as illustrated in FIG. 1. For example, the single semi-monocoque tubular structure as illustrated in FIG. 1 tends to be great in its tubular section and thus have smaller twisting rigidity, so that it is necessary to take appropriate measures, such as increasing the thickness of the frame 20. By contrast, in the case where two tubular bodies of the semi-monocoque structure are formed parallel to each other as illustrated in FIG. 2, the tubular bodies can have a reduced sectional area, so that the twisting rigidity can be increased without the thickness of the frame 20 being increased. In addition, the two tubular bodies can enhance the rigidity of the entire keyboard apparatus in an additive or synergistic manner.

Generally, keyboard apparatus have a rectangular parallelepiped configuration having, in the order of decreasing dimension, a length or width (i.e., dimension in the note scale or key-arranged direction), depth (i.e., dimension from the front edge to the rear edge of the keyboard apparatus) and height. In such keyboard apparatus, a twist occurs in a plane defined by the width and depth. The construction of the instant embodiment shown in FIG. 2, where two channel-shaped concave sections 21*a* and 21*b* extending in the width direction of the keyboard apparatus are arranged parallel to each other in the depth direction, is extremely advantageous in that it can enhance the rigidity against a twist that may occur in the plane defined by the width and depth. In this case, the channel-shaped concave section 21*a* closer to the front edge of the keyboard apparatus is located so as to appropriately take a depressing force applied to the key 1, so that the instant embodiment can even further enhance the bending rigidity in the longitudinal direction (i.e., width direction) of the keyboard apparatus at the time of depression of any of the keys. For example, it has been conventionally known to pivotably mount, per key, a hammer on the frame, in order to enhance a key depression feel. In such a case, a hammer mounting mechanism (e.g., mounting hole) may be provided, for each of the keys, on the upper surface of the channel-shaped concave section 21*a* closer to the front edge of the keyboard apparatus so that the key depressing force can be appropriately taken by the tubular body of the channel-shaped concave section 21*a*.

Figure 3:
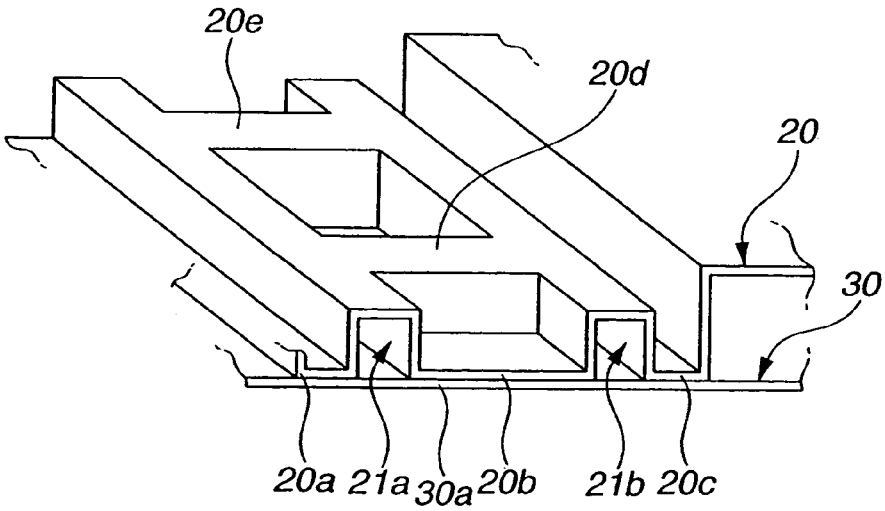
FIG. 3 is a perspective view schematically showing a modification of the frame structure in the second embodiment of the keyboard apparatus of the present invention.

FIG. 3 is a perspective view schematically showing a modification of the frame structure in the second embodiment of the keyboard apparatus of the present invention. The frame 20 of the modified frame structure includes connecting portions 20*d* and 20*e* that interconnect the two parallel channel-shaped concave sections 21*a* and 21*b* in the depth direction of the keys. Each of these connecting portions 20*d* and 20*e* too may be formed as a tubular portion having a downwardly-opening channel-like concave sectional shape, and opposite sides of the opening portion may be supported in abutment against the supporting surface 30*a* of the body section 30. Thus, the modified frame structure constitutes a ladder frame structure as a whole, which can prevent relative twisting between two tubular bodies, formed by the channel-shaped concave sections 21*a* and 21*b*, and even further enhance the rigidity of the keyboard apparatus. The connecting portions 20*d* and 20*e* may be integrally formed with other portions, such as the channel-shaped concave sections 21*a* and 21*b*, during forming of the frame 20. Alternatively, only the channel-shaped concave sections 21*a* and 21*b*, etc. may be integrally formed during the forming of the frame 20, and then the channel-shaped connecting portions 20*d* and 20*e* may be fixed to the channel-shaped concave sections 21*a* and 21*b* by suitable means, such as an adhesive, screws or male-female fitting engagement. Note that the connecting portions 20*d* and 20*e* need not necessarily be of a channel-like concave sectional shape.

Figure 4:
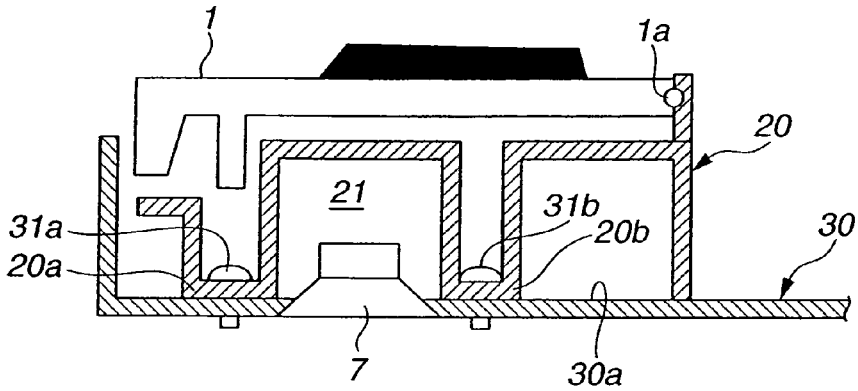
FIG. 4 is a sectional side view showing an example where a closed space formed in the frame structure in accordance with the invention is used as a speaker box.
Figure 5:
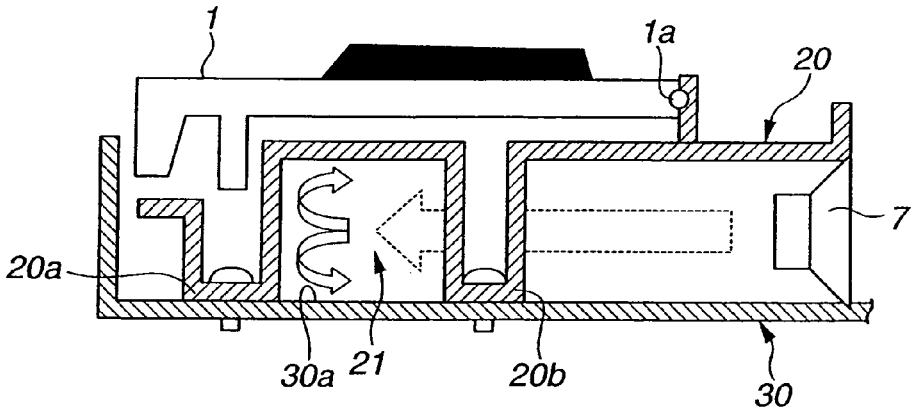
FIG. 5 is a sectional side view showing an example where the closed space formed in the frame structure in accordance with the invention is used as a bass port.

The closed spaces defined between the channel-shaped concave sections 21*a* and 21*b* (hereinafter, one of the channel-shaped concave sections is indicated by 21 for convenience of description), formed to enhance the rigidity of the keyboard apparatus, and the body section 30 can be suitably used for various other purposes. FIGS. 4 and 5 show example usage of the closed space where the closed space of the channel-shaped concave section 21 is used as a resonating space for a speaker 7 of an electronic keyboard instrument that is an embodiment of the keyboard apparatus of the present invention. More specifically, FIG. 4 shows an example where the speaker 7 is mounted, on a suitable position of the body section 30 facing the closed space, in an outwardly-facing orientation and the closed space of the channel-shaped concave section 21 is used as a speaker box. FIG. 5 shows an example where the speaker 7 is mounted, on a suitable position of the frame 20 separate from the closed space of the channel-shaped concave section 21, in an outwardly-facing orientation and the closed space of the channel-shaped concave section 21 is used as a bass port for a sound generated by the speaker 7; the bass port allows low frequency components of the sound to resonate.

Figure 6A:
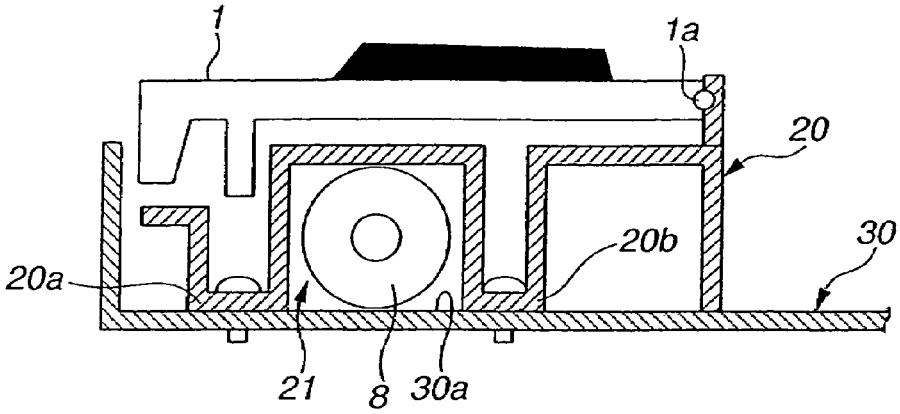
FIGS. 6A and 6B are sectional side views showing other examples where the closed space of the channel-shaped concave section is used as a space for storing a battery.
Figure 6B:
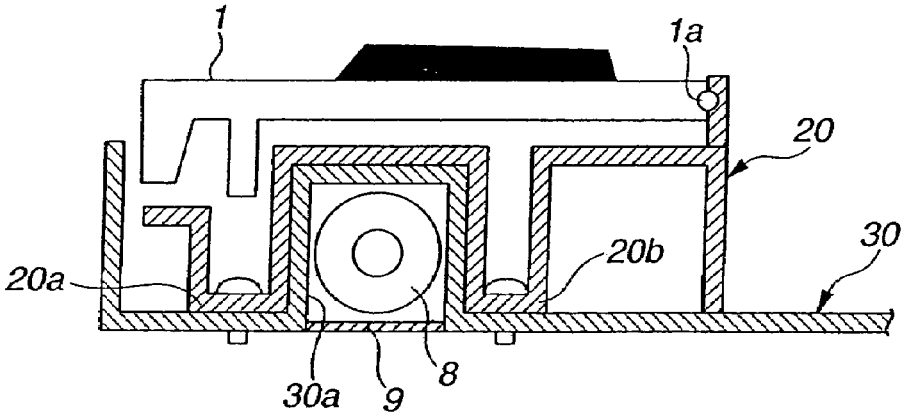
Figure 7:
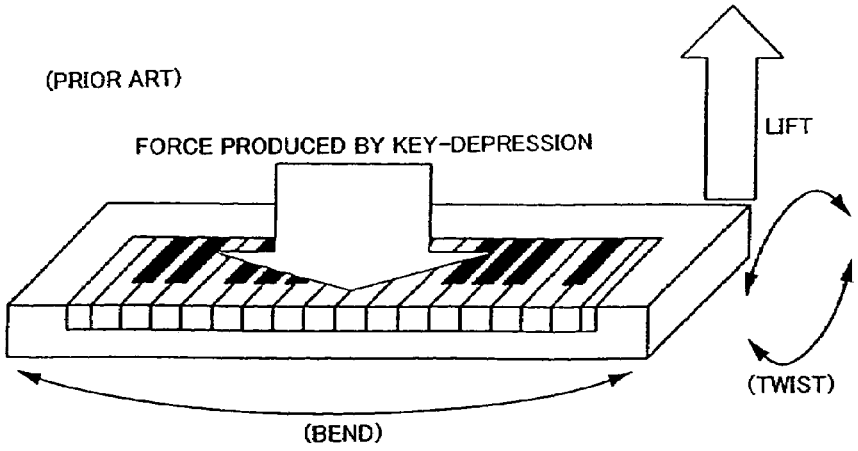
FIG. 7 is a perspective view showing a typical outer appearance of a conventional electronic keyboard instrument.
Figure 8:
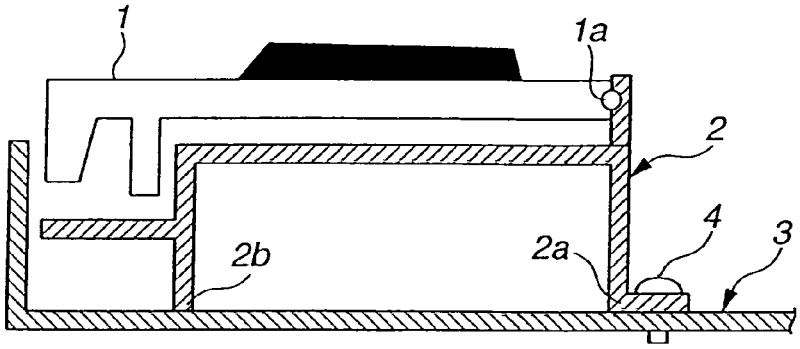
FIG.8 (PRIOR ART)
FIG. 8 is a sectional view showing examples of shapes and mounting structures of a frame and casing in a conventional electronic keyboard instrument (keyboard apparatus)
Figure 9:
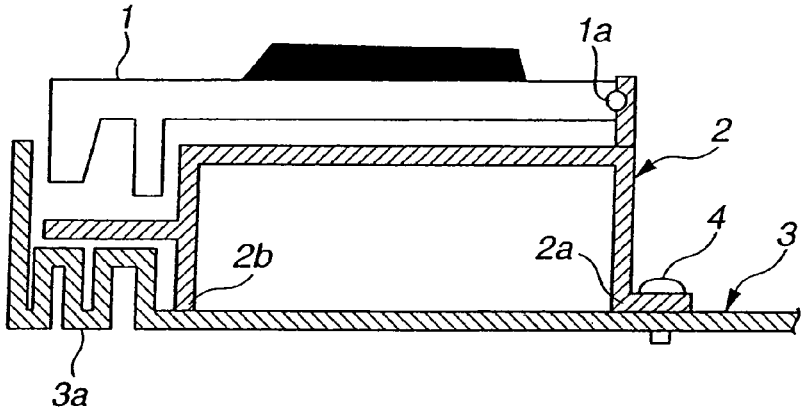
FIG.9 (PRIOR ART)
FIG. 9 is a sectional view showing other examples of shapes and mounting structures of a frame and casing in a conventional electronic keyboard instrument (keyboard apparatus)
Figure 10:
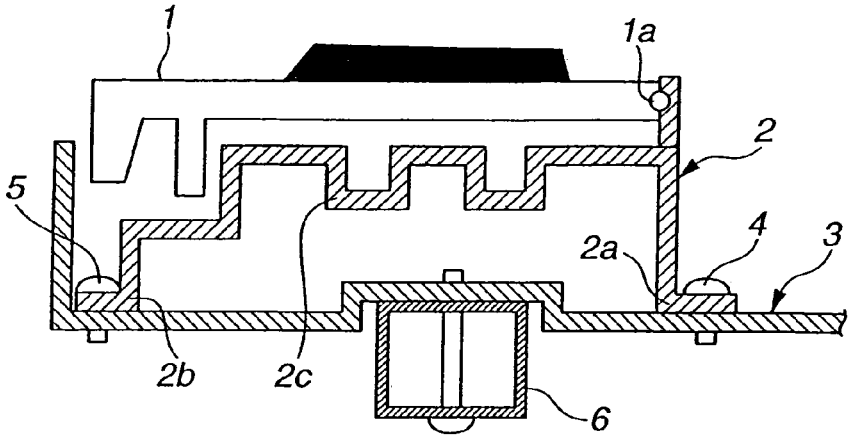
FIG.10 (PRIOR ART)
FIG. 10 is a sectional view showing still other examples of shapes and mounting structures of a frame and casing in a conventional electronic keyboard instrument (keyboard apparatus)

FIGS. 6A and 6B show other example usage of the closed space where the closed space of the channel-shaped concave section 21 is used as a space for storing a battery of the electronic keyboard instrument (built-in battery type). More specifically, FIG. 6A shows an example where the closed spaces defined between the channel-shaped concave section 21 and the body section 30 is used as a space for storing the battery 8; in this case, a battery inlet/outlet port (not shown) is formed in a predetermined portion of the body section 30. FIG. 6B shows an example where the supporting surface 30*a* of the body section 30 is bent along the inner surface of the channel-shaped concave section 21 and a concave space formed by the thus bent body section 30 is used as the space for storing the battery 8; in this case, a battery case with a lid 9 may be fitted in the concave space of the bent body section 30. The construction where the supporting surface 30*a* of the body section 30 is bent along the inner surface of the channel-shaped concave section 21 to form the concave space as shown in FIG. 6B may be employed as an ordinary modification of the present invention, without the concave space being limited to the use as the battery storing space alone. Further, the closed space of the channel-shaped concave section 21 may be used as a box for storing various circuits, or for any other suitable purpose. By allowing the channel-shaped concave section 21 to function both as a means for enhancing the rigidity of the keyboard apparatus and as a means for storing the battery, circuits or the like, the present invention can provide a frame structure of an increased efficiency.

Lastly, with reference to FIG. 11, a description will be given about a specific example construction of an electronic musical instrument to which is applied a keyboard apparatus 100 according to an embodiment of the present invention.

Figure 11:
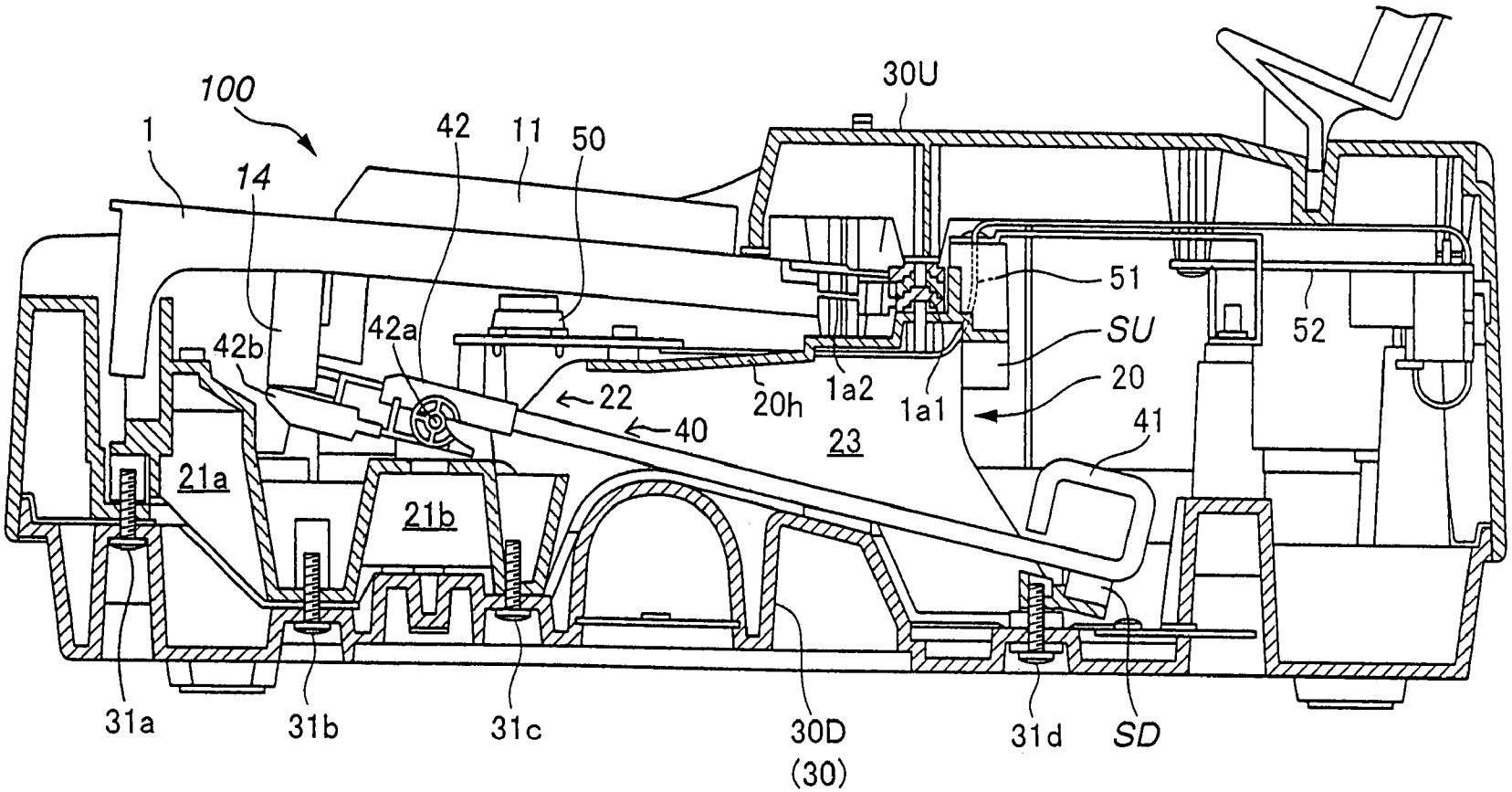
FIG. 11 is a sectional side view showing a specific example of construction of an electronic musical instrument to which is applied a keyboard apparatus according to an embodiment of the present invention.

In the electronic musical instrument of FIG. 11, a body case comprises a lower case 30D and an upper case 30U, and a frame 20 of the keyboard apparatus 100 is fixed to the lower case 30D by means of screws 31*a*, 31*b*, 31*c* and 31*d*. Namely, the lower case 30D of the electronic musical instrument corresponds to the aforementioned body section (casing) 30. Such fixation by the group of screws 31*a*, 31*b*, 31*c* and 31*d* is employed at a plurality of positions along the direction the keys of the keyboard apparatus 100 are arranged (i.e., key-arranged direction). The keyboard apparatus 100 illustrated in FIG. 11 is of a type where the frame 20 has two channel-shaped concave sections 21*a* and 21*b* as in the second embodiment of FIG. 2. The upper case 30U is formed to cover rear portions of the keys 1 of the keyboard apparatus 100.

Each of white keys 1 is included in a key unit comprising a plurality of (e.g., four or three) white keys integrally formed of white synthetic resin. In the key unit, respective rear end portions of the keys 1 are formed as, and connected together via, a common fixation section 1*a*, and these keys are fixed to the frame 20 via the common fixation section 1*a*. Further, each of the keys 1 has a small-thickness rear end region 1*a*2, and this small-thickness rear end region 1*a*2 functions as a "hinge" that permits vertical pivoting movement of the key 1. Thus, the common fixation section 1*a* and small-thickness region 1*a*2 in the illustrated specific example of FIG. 11 correspond to the supporting point 1*a* of the key 1 shown in FIG. 1 etc. Each of black keys 11 too is included in a key unit comprising a plurality of black keys integrally formed of black synthetic resin, respective rear end portions of the black keys 11 are formed as, and connected together via, a common fixation section, and each of the black keys 11 has a small-thickness region; however, reference characters of the common fixation section, small-thickness rear end region, etc. of the black keys 11 are not shown in the figure to avoid complexity of illustration.

Hammer structure 40 is provided beneath each of the white and black keys 1 and 11, and the hammer structure 40 for each of the keys 1 and 11 is supported by the frame 20. The hammer structure 40 comprises a mass rod (or mass member) 41 and an actuation section 42 holding an end of the mass rod 41, and the hammer structure 40 is supported by the frame 20, via a shaft 42*a* of the actuation section 42, for vertical pivotal movement with the shaft 42*a* functioning as a supporting point. The actuation section 42 has at its distal end vertically-spaced connecting pieces 42*b* (only the lower connecting piece 42*b* is shown in the figure), and a horizontal connecting plate (not shown) formed at the lower end of an operating section 14 of the key 1 is inserted between the upper and lower connecting pieces 42*b* to thereby couple the hammer structure 40 to the key 1. As the key is depressed, the operating section 14 of the key 1 depresses the actuation section 42 of the hammer structure 40 so that the hammer structure 40 pivots about the shaft 42*a* in a counterclockwise direction of FIG. 11. Conversely, as the key is released, the hammer structure 40 pivots in a clockwise direction of FIG. 11 due to the empty weight of the mass rod 41, and the key 1 returns to its original position through cooperation of the hammer structure 40 and resilient force of the small-thickness rear end region 1*a*2 of the key 1.

The frame 20 has an opening 22 to permit passage therethrough of the mass rod 41. Further, a rear portion 20*h* of the frame 20 is located high enough to permit vertical pivoting movement of the mass rod 41 projecting rearwardly beyond the opening 22. Thus, a space 23 is formed between the lower case 30D and the frame 20, and the hammer structure 40 (mass rod 41) is vertically pivotable within the space 23. Further, stoppers SD and SU, formed of felt or the like, are fixed to predetermined rear lower and rear upper end portions of the frame 20, and the vertical pivoting range of the hammer structure 40 is limited by these stoppers SD and SU.

Because the hammer structure 40 imparts, by the empty weight of the mass rod 41, a biasing force to the operating section 14 of the key 1 in an opposite direction from a depressing force applied to the key, the key 1 can be returned to its original position by the empty weight of the hammer structure 40 plus the resilient force of the small-thickness rear end region 1*a*2 of the key 1. Therefore, no particular key-returning means, such as a spring, is required in this case. Further, the weight of the hammer structure 40 can impart a good key touch feeling to a finger of the human player when depressing the key 1. Furthermore, a key switch 50 is provided at a predetermined position beneath the key 1, and this key switch 50 is connected via a lead 51 to a main circuit board 52 positioned rearwardly of the key.

What is claimed is:

1. A keyboard apparatus comprising:

a plurality of keys;

a frame on which said plurality of keys are operably mounted, said frame having a continuous surface defining a channel-shaped section extending in a direction where said plurality of keys are arranged on and along said frame;

a body section in which said frame is mounted, said body section having a supporting surface that contacts opposite sides of an opening of the channel-shaped section of said frame when said frame is mounted in place therein; and a fixation section where the opposite sides of the opening of the channel-shaped section of said frame are fixed to the supporting surface of said body section;

wherein the continuous surface of said frame defines at least two said channel-shaped sections parallel to each other; and wherein said frame further comprises a connecting portion that interconnects the adjacent two channel-shaped sections.

2. An electronic keyboard instrument comprising:

a plurality of keys;

a frame on which said plurality of keys are operably mounted; said frame having a continuous surface defining a channel-shaped section extending in a direction where said plurality of keys are arranged on and along said frame;

a body section in which said frame is mounted, said body section having a supporting surface that contacts opposite sides of an opening of the channel-shaped section of said frame when said frame is mounted in place therein; and a fixation section where the opposite sides of the opening of the channel-shaped section of said frame are fixed to the supporting surface of said body section;

wherein a speaker is positioned in such a manner that a space defined by the channel-shaped section of said frame and said body section is used as a resonating space for the speaker.

3. An electronic keyboard instrument of a built-in battery type comprising:

a plurality of keys;

a frame on which said plurality of keys are operably mounted; said frame having a continuous surface defining a channel-shaped section extending in a direction where said plurality of keys are arranged on and along said frame;

a body section in which said frame is mounted, said body section having a supporting surface that contacts opposite sides of an opening of the channel-shaped section of said frame when said frame is mounted in place therein; and a fixation section where the opposite sides of the opening of the channel-shaped section of said frame are fixed to the supporting surface of said body section;

wherein a battery is positioned in such a manner that a space defined by the channel-shaped section of said frame and said body section is used as a space for storing a battery.

* * * * *